United States Patent [19]

Callet et al.

[11] 4,215,725

[45] Aug. 5, 1980

[54] DEAERATING VALVE FOR BAGGING PULVERULENT PRODUCTS

[75] Inventors: Robert Callet; Henri Jeantet, both of Chaumont, France

[73] Assignee: Societe Anonyme des Imprimerie et Papeterie de l'Est., Chaumont, France

[21] Appl. No.: 960,102

[22] Filed: Nov. 13, 1978

[30] Foreign Application Priority Data

Nov. 17, 1977 [FR] France ..... 77 34659

[51] Int. Cl.[2] ..... B65B 1/26

[52] U.S. Cl. ..... 137/855; 137/550; 141/65

[58] Field of Search ..... 137/205, 550, 843, 855; 141/7, 8, 10, 59, 63, 64, 65, 67, 68, 114, 286, 325; 55/372; 406/171

[56] References Cited

U.S. PATENT DOCUMENTS 773,876 11/1904 Lorillard ..... 141/8

1,977,139 10/1934 O'Brien ..... 55/372 X 2,821,338 1/1958 Metzger ..... 141/65 X

FOREIGN PATENT DOCUMENTS 2353452 12/1977 France .

*Primary Examiner*—Frederick R. Schmidt

*Attorney, Agent, or Firm*—Frost & Jacobs

[57] ABSTRACT

A deaerating valve for bagging fluidized pulverulent products into sacks of the open-mouth type. The valve includes a filtering sheet housed on the inside of the sack to be filled, this sheet having a texture and a thickness such that it multiplies the suction effect through the valve and plays the role of a "wick" to drain the air into a large space. The dimensions of the sheet are considerable with respect to those of the deaerating valve; its surface area may attain that of the flat spread-out sack. The invention is useful in the removal of air from impermeable bags designed to receive a micromized pulverulent product.

6 Claims, 2 Drawing Figures

DEAERATING VALVE FOR BAGGING PULVERULENT PRODUCTS

FIELD OF THE INVENTION

The present invention relates to a deaerating valve for bagging fluidized pulverulent materials.

The invention is applied more particularly to the deaerating valves described in French Pat. No. 76.01.112 and designed for equipping bags or sacks of the "open-mouth" type and having an impermeable wall.

DESCRIPTION OF THE PRIOR ART

It is recalled that this type of valve is formed from two superposed elements of plastics film fastened together so as to form a fluid-tight intermediate space between them terminated by a channel, said valve being fixed to the outside of the flexible wall of a package and placed in communication with the inside of the latter to enable removal of the air and facilitate the bagging of the pulverulent materials which are fluidized to facilitate their transportation and their handling, that is to say, suspended in air so as to have a mixture of apparent density much less that that of the material alone. The problem consists therefore at the moment of bagging, of removing this air which serves as a vehicle for the material in order to effect optimum filling of the bags.

In fact, in an "open-mouth" bag, the filling is carried out suddenly at a high flow rate through an inlet orifice (the "mouth" of the sack) of large size. In order that this filling may be carried out as well as possible, without too great a cloud of dust, and without over-pressure in the sack, it is important to remove the air contained in the latter as fast as possible to leave room for the material. To do this, suction is provided through a pocket-shaped valve of the type described in the aforesaid French Patent.

Now, notably in the case of fine grain powdered materials, the suction of the air from the sack at the moment of bagging leads to the sucking also of the grains of material which escape through the valve through the perforations in the wall of the package.

To avoid this drawback, it has already been proposed, notably in French Pat. No. 76.17.104, to insert a filter between the two film elements forming the valve, this filter covering the perforations ensuring the communication with the inside of the bag. This method gives advantageous results as long as the grains of material are not too fine since, with a micromized powder, a block of material is formed around the filter which rapidly becomes impermeable to the air before the end of the bagging.

One means to retard to the maximum the moment when the filter becomes completely obturated, thus rendering removal of air impossible, consists of using an over-size filter, but the valve is over-sized by the same occasion, and very quickly becomes necessarily limited.

Another factor intervening in the sense of slowing up of the filling of the sack arises through outlet cross-section offered by the perforations of this valve not comparing with the inlet cross-section of the mouth of the bag; suction through said perforations hence is found to be quickly insufficient due to the fact that it is only exerted over a very localized area of the wall, for example at mid-height or at the bottom of the sack; this area has only a relatively small surface area and moreover, it is necessary to filter the air emerging through the perforations to avoid leakage of the pulverulent material, which further increases pressure drops at the outlet. Consequently, the suction of the layers of air distant from the perforations is effected very badly and, in certain cases not at all.

It is hence important not only to filter and to suck the air through a localized area of the wall but also to seek out this air throughout the extent of the sack to avoid the formation of air pockets at certain places and to empty as fast as possible the internal space of the bag of all its air.

It is hence essentially an object of the invention to provide a deaerating valve, notably for an open-mouth bag and with an impermeable wall, which not only ensures filtering of the air being removed but especially enables the air to be removed rapidly and completely from the inside of the bag during its filling and avoids the formation of air pockets in the mass of the material.

GENERAL DESCRIPTION OF THE INVENTION

According to the invention there is provided a deaerating valve for a sack, notably an open-mouth sack designed to receive an atomized pulverulent material, said valve comprising two superposed film elements made fast so as to form a pocket providing a fluid-tight inner space terminating in at least one suction channel, the outer surface of one of the elements being fixed to the outer surface of the wall of the sack along a closed contour which bounds a zone comprising perforations through said element and the wall, these perforations being arranged opposite so as to cause the inside of the sack to communicate with the inside of the pocket of the valve, and the filtering sheet or plate with a porous texture being applied on the inner surface of the perforated wall of the sack in front of the perforations, said filtering sheet being a draining sheet which extends far beyond the perforation zone along the wall of the sack and possesses large thickness and surface area with respect to the dimensions of the suction pocket to facilitate the drainage of air to the latter in the manner of a wick.

Preferentially, the surface area of the sheet is selected so as to be close to that of the flat spread-out bag and the material constituting said sheet is of felt or of synthetic foam with an open structure.

The invention therefore consists of adding to a pocket shaped valve, provided for deaerating a sack for filling through the "open-mouth", a drainage sheet or plate which extends well beyond the outlet perforations so as to drain, in wick-like manner, distant air pockets.

Due to the fact that to enable the internal circulation of the air the drainage sheet must have a porous texture, it is also used as a filter at the level of the perforations but its main function is firstly to drain the distant air streams and bring them together into the zone including the suction holes.

In other words, the sheet with a porous texture applied according to the invention to the inner surface of the perforated wall of the sack extends largely beyond the perforation zone, possesses a large thickness and ensures two functions, namely, one function which consists of proceeding with the collection of the air streams far within the sack, of draining them towards the perforations and of bringing them together on the latter and that of filtering the thus drained air, said sheet including then as a network of multiple channels converging towards the suction zone where the perforations are placed, the mouths of said channels constituting as many air take-ups distant from the perforations and distributed over the whole extent of the sack.

BRIEF DESCRIPTION OF THE DRAWINGS

The invention will now be described in more detail with reference to a particular embodiment given purely by way of non-limiting example and shown in the accompanying drawings, in which.

DESCRIPTION OF THE PREFERRED EMBODIMENT

Figure 1:
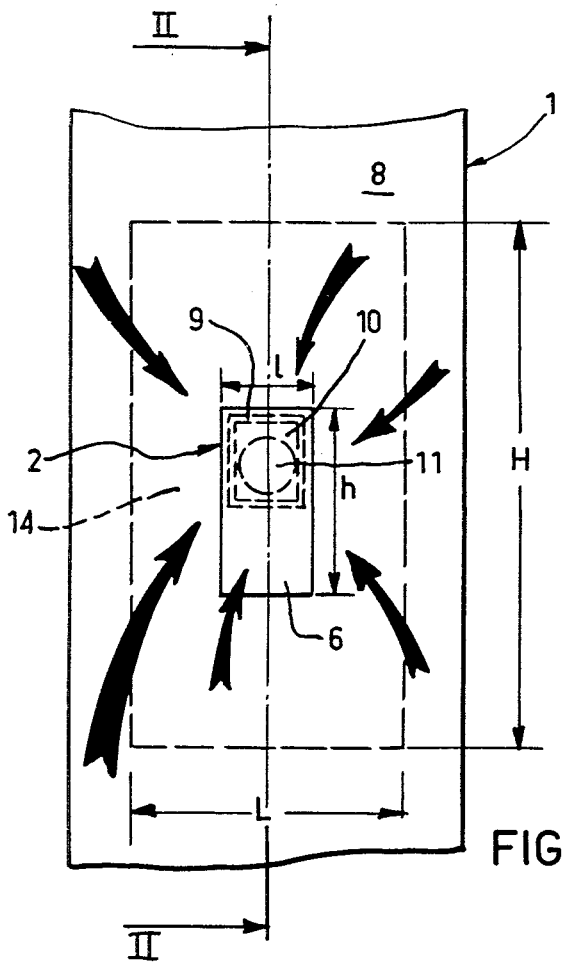
FIG. 1 shows a view from above of an embodiment of the invention including the valve and the sack arranged flat.
Figure 2:
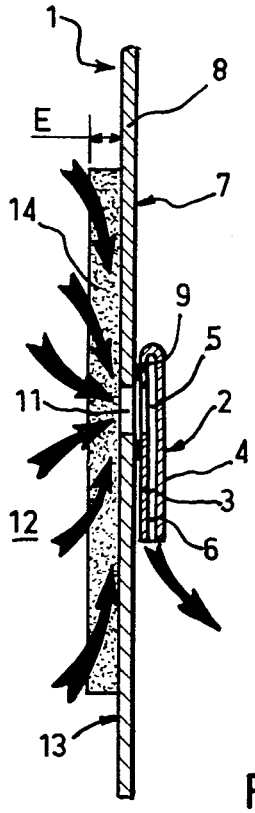
FIG. 2 shows a section along the line II—II of FIG. 1.

As shown in FIGS. 1 and 2, the flexible bag 1, for example of plastics material, comprises a valve 2 formed of two superposed plastic film elements 3 and 4 (c.f. FIG. 2) made fast both at one end and at the side edges so as to form a fluid-tight inner space 5 communicating with the outside through a suction channel 6, the element 3 adjacent to the outer surface 7 of one wall 8 of the sack 1 being welded to the latter by a weld bead 9 with closed contour bounding an area 10, in which are formed coincident openings 11 both through the wall 8 of the sack 1 and through the element 3 of the valve, these openings 11 placing the inside 12 of the sack 1 in communication with the inner space 5 of the valve 2.

Against the inner surface 13 of the wall 8 of the sack 1 is flattened and fixed a filtering plate 14 centered substantially on the openings 11 formed through said wall 8 and the adjacent element 3 of the valve 2.

This filtering plate 14 is in the form of a thick sheet, for example of felt or of synthetic foam with an open structure, whose thickness E is sufficient to permit the passage of air into the latter; the dimensions (H, L) of the filtering sheet or plate are large in comparison with those (h, l) of the valve 2 and the surface area of the sheet may even reach that of the flattened spread-out sack.

In this manner, on sucking air from the sack 1 through the outlet channel 6 of the valve 2, the air is aspirated through the openings 11 substantially at the middle of the filtering sheet 14 whose texture and thickness enable suction over the whole of its surface oriented toward the inside of the sack. The air currents shown diagrammatically by the arrows in heavy lines lead through the sheet 14 on all sides, both in the thickness of the latter, parallel to its large surfaces, and perpendicularly to the latter to be concentrated at the outlet openings 11. The sheet thus plays the role of a "wick" or of a drain to multiply the suction effect and to drain the air in a large volume, which is achieved by the fact that the air carried inside the sheet can circulate along the three dimensions of the latter.

Due to the large filtering surface which it is thus possible to obtain by housing the filtering plate no longer in the valve, but directly in the sack, it is easily possible to deaerate the product and the inside of the sack completely during the whole duration of bagging without fear of total clogging which would interrupt the operation.

Of course, the scope of the invention is not limited to the single embodiment described above by way of non-limiting example, but it covers also all modifications which differ only in detail.

I claim:

1. Deaerating valve for a sack, notably an open-mouth sack designed to receive an atomized pulverulent substance, said valve comprising two superposed film elements fastened together so as to form a suction pocket constituting a fluid-tight inner space terminated by at least one suction channel, the outer surface of one of the elements being fixed to the outer surface of the wall of the sack along a closed contour which bounds a zone comprising perforations through said element and the wall, these perforations being arranged in opposite relationship so as to cause the interior of the sack to communicate with the interior of the pocket of the valve, and a filtering sheet or plate with a porous texture being applied on the internal surface of the perforated wall of the sack in front of the perforations, said filtering sheet being a draining sheet which extends well beyond the perforated zone along the wall of the sack and possesses a thickness and a surface area which are large with respect to the dimensions of the suction pocket to facilitate wick-like drainage of the air to the latter.

2. Valve according to claim 1, wherein a surface of the filtering sheet is juxtaposed to the perforated wall of the sack.

3. Valve according to claim 2, wherein the sheet is of felt.

4. Valve according to claim 2, wherein the sheet is constituted by a synthetic foam of open-pore structure.

5. Valve according to claim 1, wherein the sheet is of felt.

6. Valve according to claim 1, wherein the sheet is constituted by a synthetic foam of open-pore structure.

* * * * *